US008136882B2

(12) United States Patent
Kopetzky et al.

(10) Patent No.: US 8,136,882 B2
(45) Date of Patent: Mar. 20, 2012

(54) MULTI-WAY ADJUSTMENT DEVICE FOR A SEAT COMPONENT AND/OR A CABLE

(75) Inventors: Robert Kopetzky, Graz (DE); Veit Stossel, Nürnberg (DE)

(73) Assignee: Schukra Geratebau AG, Berndorf (AT)

( * ) Notice: Subject to any disclaimer, the term of this patent is extended or adjusted under 35 U.S.C. 154(b) by 1284 days.

(21) Appl. No.: 10/559,522

(22) PCT Filed: Jun. 7, 2004

(86) PCT No.: PCT/EP2004/006116
§ 371 (c)(1),
(2), (4) Date: Sep. 29, 2006

(87) PCT Pub. No.: WO2004/107918
PCT Pub. Date: Dec. 16, 2004

(65) Prior Publication Data

US 2007/0152492 A1 Jul. 5, 2007

(30) Foreign Application Priority Data

Jun. 6, 2003 (DE) ..... 103 25 849

(51) Int. Cl.
*A47C 3/00* (2006.01)

(52) U.S. Cl. ..... 297/284.4; 297/284.8; 297/284.7

(58) Field of Classification Search ..... 297/284.4, 297/284.8, 284.7, 301.4, 404
See application file for complete search history.

(56) References Cited

U.S. PATENT DOCUMENTS 2,901,027 A * 8/1959 Dickson ..... 297/301.7
4,084,850 A 4/1978 Ambasz
4,212,495 A 7/1980 Gall
4,226,468 A 10/1980 Johnson
5,797,653 A 8/1998 Elzenbeck et al.
6,068,336 A * 5/2000 Schonauer ..... 297/284.9
6,199,951 B1 * 3/2001 Zeile et al. ..... 297/341
6,254,187 B1 * 7/2001 Schuster et al. ..... 297/284.1
6,357,826 B1 * 3/2002 Gabas et al. ..... 297/284.4
6,523,898 B1 * 2/2003 Ball et al. ..... 297/320
6,616,227 B2 * 9/2003 Blendea et al. ..... 297/284.4

(Continued)

FOREIGN PATENT DOCUMENTS

DE 3701058 7/1988

(Continued)

*Primary Examiner* — Laurie Cranmer
(74) *Attorney, Agent, or Firm* — Michael Best & Friedrich LLP

(57) ABSTRACT

A multi-way adjustment device, in particular a two-way adjustment device, is proposed for a seat component, which is suitable in particular for the seat-back width adjustment of a seat. The multi-way adjustment device comprises an adjustment part (7) adjustably mounted relative to a mounting plate a (1), which when moved in a first adjustment direction (A) requires less energy expenditure than when moved in a second adjustment direction (B). In order to compensate this, there are provided mechanical energy accumulation means (5), which takes up mechanical energy when the movement is in the first adjustment direction (A), in order to release this when the movement is in the second adjustment direction (B) and thus to assist the movement of the adjustment part (7) in the second adjustment direction (B). Moreover, the invention relates to a corresponding adjustment device for a cable, in particular a Bowden cable, in order, for example, to adjust a lumbar support for a seat with respect to curvature or height position.

12 Claims, 2 Drawing Sheets

U.S. PATENT DOCUMENTS

Figure 1:
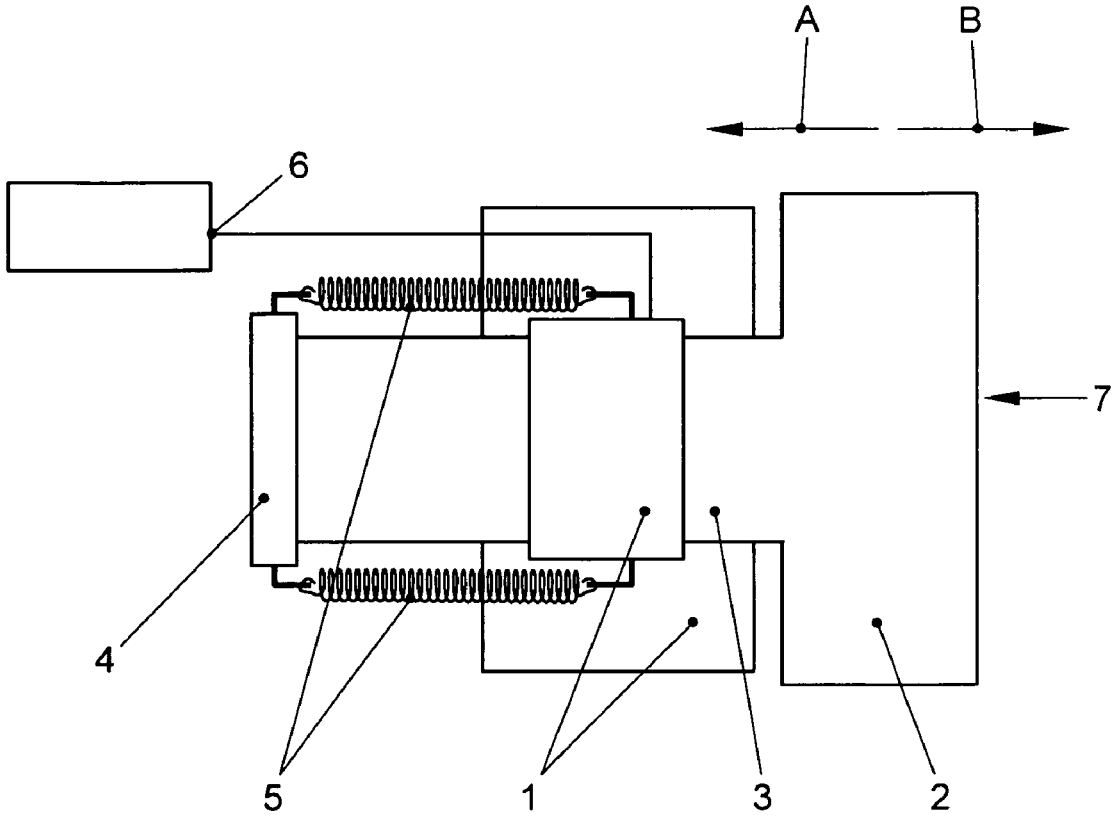

| | | | | |
|---|---|---|---|---|
| 6,631,951 | B2 * | 10/2003 | Blendea et al. | 297/284.4 |
| 6,692,074 | B1 * | 2/2004 | Kopetzky et al. | 297/284.8 |
| 6,918,884 | B2 * | 7/2005 | Knelsen et al. | 601/57 |
| 7,201,446 | B2 * | 4/2007 | Massara et al. | 297/284.4 |
| 2003/0015901 | A1 | 1/2003 | Och et al. | |
| 2003/0062749 | A1 | 4/2003 | Liu et al. | |
| 2003/0085599 | A1 | 5/2003 | McMillen | |

FOREIGN PATENT DOCUMENTS

| | | | |
|---|---|---|---|
| DE | 19603911 | | 8/1997 |
| DE | 29903389 | | 5/1999 |
| DE | 10203563 | | 8/2003 |
| GB | 385157 | | 12/1932 |
| GB | 609242 | | 9/1948 |
| JP | 06261818 | A * | 9/1994 |

* cited by examiner

MULTI-WAY ADJUSTMENT DEVICE FOR A SEAT COMPONENT AND/OR A CABLE

The present invention relates to a multi-way adjustment device for a seat component, for example, a seat-back or a head restraint. In particular, the present invention relates to a multi-way adjustment device for a seat component, in the case of which for movement of the corresponding seat component in a first adjustment direction less energy must be applied than for movement in a (in particular opposite) second adjustment direction. Moreover, the present invention relates to a multi-way adjustment device for a cable, in particular a Bowden cable, in order to reduce the energy to be applied in an adjustment direction.

Current systems for the seat-back width adjustment of seats, so-called bolster systems, are extremely stressed on one side. Systems of this kind for seat-back width adjustment comprise a glider or a slider mounted adjustably in a housing or a mounting plate, which is coupled with a corresponding seat-back section. For reducing the seat-back width, a substantially greater energy than for increasing the seat-back width must be applied since the glider must compress a corresponding cushion section of the respective seat-back. The consequence of this is that a drive unit provided for adjusting the glider must be designed particularly for that load or adjustment direction, which requires more energy, again leading to over-dimensioning of the drive unit, whereby in the case of electrical drive units these must be able to provide correspondingly high currents.

This problem in principle not only arises in systems for seat-back width adjustment, but with all seat components to be adjusted in two or more adjustment directions, whereby movement in at least one adjustment direction requires greater energy expenditure than movement in at least another adjustment direction. Likewise, this problem also occurs in a system for adjusting a cable, for example a Bowden cable. Bowden cables are often used, for example, for the adjustment of lumbar supports and are adjusted by so-called actuators. In the process, a corresponding adjustment force has to be applied via the corresponding actuator in order, for example, for the curvature of the lumbar support to be adjustable in the desired manner. If the curvature of the lumbar support is to be adjusted in the process against a user resting against the lumbar support, a correspondingly high adjustment force has to be applied via the actuator, with this applying equally to both manually and electrically driven actuators.

Therefore, the object of the present invention is to make available an improved multi-way adjustment device for a seat component, in which this problem is surmounted and over-dimensioning of the drive or adjustment unit provided for adjusting the seat component can be avoided. Furthermore, the present invention is based on the object of providing an improved multi-way adjustment device for a cable of the type described above, in which the energy required to adjust the cable in one of the adjustment directions can be reduced.

This object is achieved according to the invention by a multi-way adjustment device for a seat component with the features of claim 1 and an adjustment device for a cable with the features of claim 17. The sub-claims define preferred or advantageous embodiments of the present invention.

The multi-way adjustment device according to the invention comprises a mounting plate with an adjustment part adjustably mounted relative to the mounting plate, which is to be coupled with the corresponding seat component to be adjusted. Furthermore, an adjustment unit is provided for adjusting the adjustment part relative to the mounting plate. The adjustment part is coupled with mechanical energy accumulation means in such a manner that when the adjustment part is moved in at least a first adjustment direction mechanical energy is taken up by the mechanical energy accumulation means, while when the adjustment part is moved in at least a second adjustment direction this adjustment process is assisted by the mechanical energy accumulation means releasing mechanical energy previously taken up.

With the aid of the mechanical energy accumulation means, which can comprise at least one spring-elastic element, for example an industrial coil spring, the adjustment device to be precise is also loaded when moved in the first adjustment direction, so that the mechanical energy accumulation means can take up the mechanical energy. This mechanical energy is then, however, again released with the movement in the second adjustment direction, which preferably corresponds to the actual load direction of the adjustment device and usually requires greater force or energy expenditure than the movement in the first adjustment direction, and therefore assists the movement or adjustment of the adjustment part in the second adjustment direction. The consequence of this is that not only the adjustment unit, which is preferably electromechanically operated, but also the entire multi-way adjustment device can be designed with smaller dimensions.

The present invention, however, is suitable in principle for adjusting any seat components. In particular, the present invention is suitable for the seat-back width adjustment of a backrest or also for adjusting head restraints of a seat. Furthermore, the multi-way adjustment device according to the invention concerns a two-way adjustment device, whereby the two adjustment directions can run essentially opposite to each other.

Moreover, the present invention relates to a multi-way adjustment device, in particular a two-way adjustment device, for a cable, in particular a Bowden cable, wherein the cable, which with respect to the aforementioned embodiment, corresponds with regard to its function to the adjustment part, is adjustably mounted in a housing of the adjustment device. An adjustment force for adjusting the wire or cable is generated via a manually or electrically actuable adjustment unit coupled to the cable or wire of the cable in a suitable manner, and is applied to the wire or the cable. In the process, the wire or the cable is coupled to mechanical energy accumulation means of the above-described type in such a way that during an adjustment of the wire or cable in a first adjustment direction relative to the housing, mechanical energy is taken up by the mechanical energy accumulation means, while an adjustment of the wire or cable takes place in a second adjustment direction relative to the housing assisted by the release of previously taken up mechanical energy of the mechanical energy accumulation means.

The mechanical energy accumulation means are preferably coupled both to the wire or cable and to the housing, wherein the mechanical energy accumulation means can be at least one spring-elastic element which is tensioned on adjustment of the wire or cable, in the first adjustment direction in order to be relieved of tension on adjustment of the wire or cable in the second adjustment direction.

This embodiment of the present invention is suitable for use preferably in so-called actuators for Bowden cables, with which the Bowden cable can be alternately tensioned or slackened. Likewise, the invention is advantageously suitable for use in actuators in lumbar supports, in order, for example, to be able to adjust the curvature of the lumbar support via a respective Bowden cable, wherein the previously mentioned first adjustment direction corresponds to a reduction in the curvature, while the second adjustment direction corresponds to an increase in the curvature of the lumbar support. However, with the aid of the invention, in general, any desired function of a lumbar support can be adjusted, for example also the height etc.

The common principle on which the previously mentioned embodiments are based can be seen in that mechanical energy accumulation means are used in each case in order to facilitate an adjustment in a specific adjustment direction, while in each case, less energy has to be applied by the corresponding adjustment unit for adjustment in the adjustment direction, owing to the energy release from the mechanical energy accumulation means upon an adjustment in said adjustment direction.

The present invention will be described hereinafter with the aid of preferred embodiments, however, without being restricted thereto.

Figure 2:
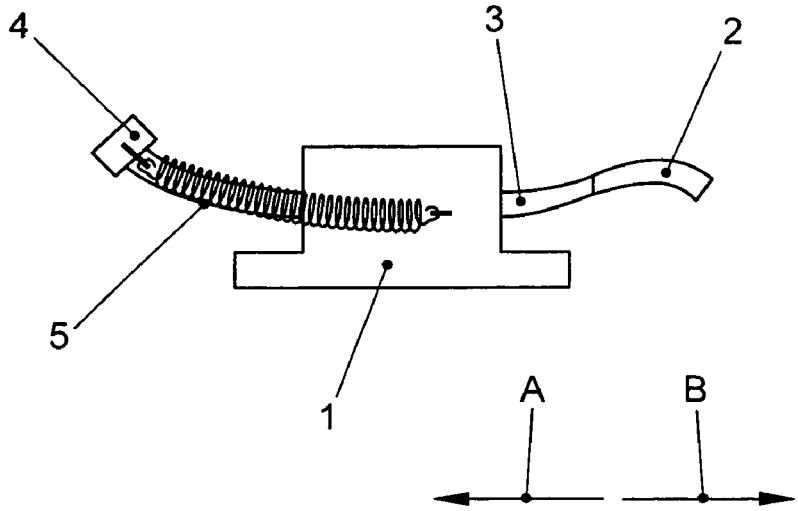
Figure 3:
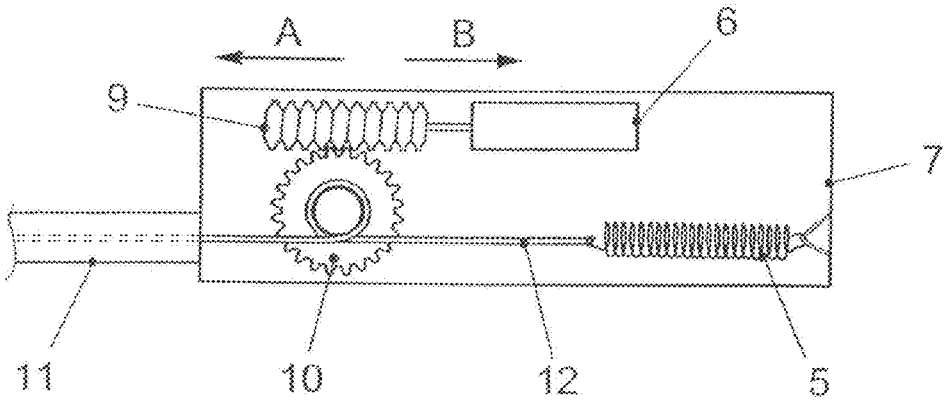

FIG. 1 shows a top view over a device for seat-back width adjustment in accordance with a preferred embodiment of the present invention, FIG. 2 shows a side view of the device illustrated in FIG. 1 and FIG. 3 shows a side view of a device for adjusting a cable according to a further embodiment of the present invention.

The adjustment device shown in FIG. 1 comprises a mounting plate 1 in the form of a glider housing and adjustment part 7 in the form of a glider mounted adjustably relative to the mounting plate 1 and to be coupled with a corresponding seat-back section of a seat. The position of the adjustment part 7 relative to the mounting plate 1 can be changed with the aid of an adjustment or drive unit 6, whereby, for example, this can concern an electromechanical adjustment unit. Since the type and method of adjustment of the adjustment part 7 by the adjustment unit 6 plays no significant part in the context of the present invention, this is not dealt with in detail below. For this purpose, any adjustment mechanism known in the art can be used.

As clear from FIG. 1, the adjustment part has two end sections 2, 4 and a middle section 3 linking these two end sections with one another. The two end sections 2, 4 in each case have a greater width than the middle section 3. That adjustment part 7 is adjustably mounted with its middle section 3 in the mounting plate 1.

Likewise, as shown in FIG. 1, the movement or adjustment of the adjustment part 7 essentially takes place in two adjustment directions, which are designated A and B. To decrease the seat-back width, the adjustment part 7 is pushed in adjustment direction B, while to increase the seat-back width the adjustment part 7 must be moved in the adjustment direction A. Since to decrease the seat-back width usually a corresponding cushion section of the backrest must be squeezed together, that is to say compressed, movement of the adjustment part 7 in the adjustment direction B in the case of conventional devices for seat-back width adjustment requires greater force or energy expenditure than movement in the adjustment direction A.

To avoid this problem, mechanical energy accumulation means is provided for the device for seat-back width adjustment illustrated in FIG. 1 and FIG. 2, that in the case of the embodiment represented comprises two industrial springs 5, which are provided on either side in the longitudinal direction of the middle section 3 of the adjustment part 7 and are coupled on the one hand with the end section 4 and on the other hand with the mounting plate 1. In particular, the configuration and arrangement of the springs 5 are such that they are tensioned with the movement of the adjustment part 7 in the adjustment direction A and therefore take up mechanical energy, while they can expand with the movement of the adjustment part 7 in the adjustment direction B, whereby the mechanical energy of the springs 5 being released assists the movement of the adjustment part 7 in the adjustment direction B, which makes less force or energy expenditure necessary for the adjustment unit 6. In addition, a more harmonious current or energy consumption of the electromechanical adjustment unit 6 is achieved.

FIG. 3 shows a side view of a device for adjusting a cable, in particular a Bowden cable, according to a further embodiment of the present invention. In particular, the adjustment device shown in FIG. 3 is a so-called actuator for a Bowden cable, the cover 11 of which is supported on the housing 7 of the actuator, while the wire 12 of the Bowden cable, which is displaceably mounted in the cover 11, is guided into the interior of the housing 7.

The wire 12 is coupled in the housing 7 to a toothed wheel 10 or fastened thereto, which toothed wheel 10 is in engagement with a gear shaft 9. The gear shaft 9 is driven by a mechanical and/or electrical adjustment or drive unit 6, so, depending on the direction of rotation of the gear shaft 9, the toothed wheel 10 in FIG. 3 is rotated either in a clockwise or anti-clockwise direction. Owing to the coupling of the wire 12 of the Bowden cable to the toothed wheel 10 the wire 12 is thus pulled to a greater or lesser extent out of the cover 11 into the housing 7 and this can, for example, be used to curve a lumbar support (not shown) coupled to the Bowden cable to a greater or lesser extent, as is known from the prior art. The manner of transmission of the adjustment force from the adjustment unit 6 to the wire 12 of the Bowden cable is not important in the scope of the present invention, so FIG. 3 is merely shown by way of example.

As can be seen from FIG. 3, the wire end of the Bowden cable located in the housing 7 is coupled to a coil spring 5, the other end of which is coupled to the inside of the housing 7, or attached thereto. The spring 5 in principle fulfils the same function as the springs described with the aid of FIG. 1 and FIG. 2, so in addition reference can be made to the above description with respect to FIG. 1 and FIG. 2. In the embodiment shown in FIG. 3, the spring 5 is also tensioned when the wire 12 is adjusted in the adjustment direction A shown in FIG. 3, in other words when the Bowden cable is slackened, and therefore takes up mechanical energy, with the result that when the wire of the Bowden cable is adjusted in the adjustment direction B, in other words when the Bowden cable is tensioned, less energy has to be applied by the adjustment unit 6 owing to the energy release of the spring 5 taking place in the process, as the adjustment takes place in the adjustment direction B assisted by the energy release of the spring 5. This results in the fact that in principle, to tension the Bowden cable, in other words for adjustment in the adjustment direction B, an adjustment force only has to be applied by the adjustment unit 6, which corresponds to the difference between the adjustment force which is generally to be applied and the restoring force exerted by the spring 5. The adjustment unit 6 can therefore be produced with smaller, lighter and cheaper electric motors, and moreover, the energy consumption can be significantly reduced. A further advantage also consists in that in the embodiment shown in FIG. 3, the Bowden cable can be adjusted in the two adjustment directions A and B with more uniform adjustment forces and this is, in particular, advantageous in the use of a manual adjustment unit 6, as the user does not then notice any jolt or the like on adjustment of the Bowden cable.

Obviously—depending on the respective area of use—it is also conceivable to modify the arrangement shown in FIG. 3 in such a way that the spring 5 takes up energy when the Bowden cable is tensioned in order to facilitate a slackening of the Bowden cable by release of the previously takes up mechanical energy.

The invention claimed is:

1. Multi-way adjustment device for adjusting a rest width of a seat, the multi-way adjustment device comprising a mounting plate, an adjusting part which is mounted so as to be displaceable relative to the mounting plate and is to be coupled with a rest portion of the seat, whereby the adjusting part is of an elongate design with a middle portion disposed between a first end portion and a second end portion with the first end portion having a bigger width than the middle portion, the adjusting part being mounted so as to be displaceable on the mounting plate by means of the middle portion, and an adjusting unit for displacing the adjusting part relative to the mounting plate in a first adjustment direction and a second adjustment direction, whereby one of the first and second adjustment directions is for reducing the rest width and the other of the first and second adjustment directions is for increasing the rest width, whereby the adjusting part is coupled with mechanical energy storage means in such a way that, when the adjusting part is displaced in the first adjustment direction relative to the mounting plate, mechanical energy is absorbed by the mechanical energy storage means, whereas a displacement of the adjusting part in the second adjustment direction relative to the mounting plate is assisted by the release of the mechanical energy previously absorbed by the mechanical energy storage means.

2. Multi-way adjustment device as claimed in claim 1, characterised in that the first adjustment direction is essentially opposite to the second adjustment direction.

3. Multi-way adjustment device as claimed in claim 1, characterised in that the adjusting unit is electro-mechanically operated.

4. Multi-way adjustment device as claimed in claim 1, characterised in that the first end portion is to be coupled with the rest portion and the second end portion is to be coupled with the mechanical energy storage means.

5. Multi-way adjustment device as claimed in claim 4, characterised in that the mechanical energy storage means has at least one resiliently elastic element which absorbs mechanical energy when the adjusting part is displaced in the first adjustment direction and releases mechanical energy when the adjusting part is adjusted in the second adjustment direction, and in that the at least one resiliently elastic element is coupled on the one hand with the second end portion of the adjusting part and on the other hand with the mounting plate.

6. Multi-way adjustment device as claimed in claim 1, characterised in that the mechanical energy storage means are coupled on the one hand with the adjusting part and on the other hand with the mounting plate.

7. Multi-way adjustment device as claimed in claim 6, characterised in that the mechanical energy storage means comprises two resiliently elastic elements, one of which resiliently elastic elements is disposed along a longitudinal side of the adjusting part.

8. Multi-way adjustment device as claimed in claim 1, characterised in that the mechanical energy storage means has at least one resiliently elastic element which absorbs mechanical energy when the adjusting part is displaced in the first adjustment direction and releases mechanical energy when the adjusting part is adjusted in the second adjustment direction.

9. Multi-way adjustment device as claimed in claim 8, characterised in that the at least one resiliently elastic element is designed and disposed so that it is tensioned as the adjusting part is displaced in the first adjustment direction and relaxed when the adjusting part is displaced in the second adjustment direction.

10. Multi-way adjustment device as claimed in claim 1, characterised in that the second end portion has a bigger width than the middle portion.

11. Seat with a multi-way adjustment device as claimed in claim 1 for adjusting the rest portion of the seat.

12. Use of a multi-way adjustment device as claimed in claim 1 for adjusting the rest width of the seat.

* * * * *